US005899377A

United States Patent [19]

Speese et al.

[11] Patent Number: 5,899,377

[45] Date of Patent: May 4, 1999

[54] SANDWICH BOX

[75] Inventors: Scott Speese, Oshtemo; David M. Hanna, Augusta, both of Mich.

[73] Assignee: Arvco Container Corporation, Kalamazoo, Mich.

[21] Appl. No.: 08/943,614

[22] Filed: Oct. 3, 1997

[51] Int. Cl.[6] ..... B65D 5/46

[52] U.S. Cl. ..... 229/117.13; 229/193; 229/155; 206/418

[58] Field of Search ..... 229/193, 194, 229/155, 149, 158, 103.2, 128, 418; 106/396, 541, 140, 144, 141

[56] References Cited

U.S. PATENT DOCUMENTS

| | | | |
|---|---|---|---|
| 152,636 | 6/1874 | Heyl . | |
| 1,587,038 | 6/1926 | Sandor | 206/408 |
| 1,871,888 | 8/1932 | Johnson | 229/194 X |
| 2,323,782 | 7/1943 | Kretchmer | 229/194 X |
| 2,325,277 | 7/1943 | Rothe et al. . | |
| 2,537,151 | 1/1951 | Mires | 206/418 |
| 2,624,521 | 1/1953 | Broeren | 229/193 X |
| 2,743,009 | 4/1956 | Williamson et al. | 206/396 |
| 2,758,778 | 8/1956 | Arneson | 229/155 X |
| 2,762,553 | 9/1956 | Bentz . | |
| 2,904,238 | 9/1959 | Perry et al. | 229/155 X |
| 2,990,997 | 7/1961 | Weiss | 206/140 |
| 3,184,145 | 5/1965 | Baker . | |
| 3,229,812 | 1/1966 | Metzger | 206/396 |
| 3,861,582 | 1/1975 | Bock . | |
| 4,388,993 | 6/1983 | Lavery | 229/155 X |
| 4,690,321 | 9/1987 | Spaeth . | |
| 4,749,083 | 6/1988 | Growney | 206/418 |
| 4,773,540 | 9/1988 | Schuster | 229/194 X |
| 5,150,789 | 9/1992 | Bass | 206/396 |
| 5,472,090 | 12/1995 | Sutherland | 206/140 X |

OTHER PUBLICATIONS

Three photographs and sketch of prior art box referred to as Mancino's box which is discussed in application at p. 2, line 5 through p. 3, line 23.

*Primary Examiner*—Gary E. Elkins
*Assistant Examiner*—Tri Mai
*Attorney, Agent, or Firm*—Flynn, Thiel, Boutell & Tanis, P.C.

[57] ABSTRACT

A wrapper-type box for transporting a sandwich. The box is formed from a one-piece flat blank of stiff but foldable cardboard. The blank has a main part with a plurality of parallel fold lines which divide the main part into four adjacent side walls. The main part is folded about the fold lines to assume an elongate tubular body of rectangular configuration. An edge flap and a top wall overlap and have cooperating locking tabs and slots to secure the main part in an assembled condition The edge flap also has a looplike handle formed therein. The one-piece blank also includes a pair of flaps associated with and projecting outwardly from each end. To effect closure of the end of the tubular body, the pair of flaps are folded inwardly into the box interior through a sufficient angle so that a tab on one flap passes over the other flap and projects into a slot provided on the other flap. The manual folding force is released, and the memory of the flaps causes the flaps to swing outwardly and effectively engage the tab within the slot and lock the flaps together.

11 Claims, 4 Drawing Sheets

SANDWICH BOX

FIELD OF THE INVENTION

This inventions relates to an improved wrapper which, when assembled, creates a compact and sturdy box which is particularly desirable for storing and transporting a food product such as a sandwich.

BACKGROUND OF THE INVENTION

Many retail establishments now specialize in the preparing and selling of takeout food products, particularly sandwiches Many of these sandwiches, which are sold either hot or cold, are prepared using an elongate roll or bun, such sandwiches often being referred to as submarine sandwiches. The completed sandwich is typically enclosed within a paper wrapper, with the wrapped sandwich then being typically positioned within a paper or plastic bag for transport by the purchaser. While the use of bags for the transporting of takeout sandwiches and other food products is a well known and widespread practice, nevertheless such bags are also recognized as possessing disadvantages or undesirable features. For example, many plastic bags are considered ecologically undesirable since they do not readily degrade when disposed of. Further, most bags, whether plastic or paper, do not function effectively when transporting a heated food product such as a heated sandwich since they are not capable of effectively maintaining the sandwich warm for any extended period of time. The use of bags, particularly paper bags, is also often undesirable since many of the sandwiches contain various dressings thereon which can easily effect soiling of the bag, which is obviously undesirable to the purchaser since this increases the risk of soiling of either the purchaser's clothes or of other objects on which the bag is deposited. Further, in the case of submarines sandwiches, many of which are of significant length, many bags are not conveniently configured so as to accommodate the length of the sandwich, and hence their use with such sandwiches is not compatible with optimum handling and transporting.

In recognition of the above disadvantages and in an attempt to provide an improved container for fluid products specifically submarine sandwiches, there has been developed a sandwich wrapper which is formed from a one-piece blank of corrugated cardboard. The blank is defined by a generally rectangular main body part which is provided with a plurality of generally parallel score or fold lines extending longitudinally thereof. This enables the main body part to be folded into a generally elongated rectangular box so as to confine a sandwich therein. This blank has suitable locking tabs associated with the top wall to permit securement of the box in a closed position, with the top wall also having a handle formed therein to facilitate manual grasping of the box. To close off the ends of the box, the main body part of the blank has a single end flap associated with each longitudinal edge thereof, which end flap is associated with and projects outwardly from the bottom wall of the box, being joined thereto by a suitable fold line. The fold line for this end flap is offset inwardly from the main body part of the blank so that the end flap, when folded upwardly into the box, is offset inwardly from the free end edge of the box. The blank also has a pair of transverse score lines which are formed adjacent each edge of the main body part so as to be disposed at the upper corners of the box. These transverse score lines define locking strips which, after the end flap is folded upwardly into the box, are then manually deformed downwardly through an over-center position to exteriorly overlap the upper portion of the end flap to maintain it in a closed position.

While the known wrapper-type box described above does provide for desirable containment, protection and transport of a food product such as a submarine sandwich, nevertheless this known wrapper-type box itself possesses features which are considered less than advantageous. For example, due to the construction of the end flaps and the related locking strips, the end flaps and their fold line connection to the bottom wall of the box are necessarily offset from the free edge of the main body of the blank, and this results in the overall length of the box being greater than the usable interior storage compartment, thereby resulting in wastage of space (i.e. box length) at each end of the box. This also in turn results in the box using or requiring a greater quantity of corrugated cardboard for forming the blank than would otherwise be desired. In addition, and quite significantly, the manner in which the end flaps are locked in the closed position by the deformable overcenter locking strips is rather difficult for a person to rapidly and efficiently perform, and thus the assembly of this box in conjunction with a sandwich thus lacks the desired simplicity of manipulation and efficiency of assembly.

Accordingly, it is an object of this invention to provide an improved wrapper-type box, particularly for food products such as sandwiches, which box is believed to improve upon the disadvantages associated with prior such constructions.

More specifically, it is an object of this invention to provide an improved wrapper-type box, particularly for a sandwich, which box can be constructed from a onepiece blank of corrugated cardboard and which permits ease of manipulation and assembly of the box around a sandwich, which results in a box having minimal length relative to sandwich length, which permits optimum utilization of the interior storage space of the box, which permits minimum utilization of corrugated cardboard for forming the blank, and which greatly facilitates securement of the wrapper-type box in its fully assembled condition while containing a sandwich therein More specifically, the present invention relates to an improved wrapper-type box which is particularly desirable for containing and transporting a food product such as an elongate sandwich. The box is formed from a one-piece flat blank of rather stiff but foldable material, preferably corrugated cardboard, the latter preferably being double-faced. The blank is defined primarily by a main body part which is generally rectangular and has a plurality of generally parallel fold lines extending longitudinally thereof between the opposite end edges of the main body part. The fold lines divide the main body part of the blank into a plurality of adjacent but joined side walls, including a bottom wall which joins through fold lines to two adjacent side walls, one of the side walls being joined through a fold line to an adjacent top wall, and the other side wall being joined through a further fold line to an edge flap. This main body part of the blank is folded about the fold lines so as to assume a generally elongate tubular body of generally rectangular configuration, with the edge flap and top wall suitably overlapping and being provided with cooperating locking tongues and slots so as to secure the main body part in a closed assembled condition. The edge flap also has a looplike handle formed therein by suitable cut and fold lines, which handle can be bent upwardly relative to the top wall to facilitate manual gripping and carrying of the assembled wrapper.

To close off the ends of the elongate tubular body, the one-piece blank includes a pair of flaps associated with and projecting outwardly from each end edge of the main body part. One of the flaps projects outwardly from the bottom wall and is joined thereto by a transverse fold line which is effectively aligned with the end edge of the main body part, and the other flap projects outwardly from the top wall and is joined thereto by a fold line which also extends generally in alignment with the end edge of the main body part. One of the flaps of each pair has an outwardly projecting lock tab at the free edge thereof, and the other flap has a tab-accommodating slot adjacent the free edge thereof. Each of the flaps of the pair has a length which is less than the height of the box, but the combined lengths of the flaps of the pair is significantly greater than the height of the box. To effect closure of the end of the box, the pair of flaps associated with the top and bottom walls are folded about their respective fold lines into a position wherein they extend generally transversely of the end of the box, and in fact are folded so that both flaps are angled inwardly into the box interior. The flaps are folded inwardly through a sufficient angle so that the tab on one flap passes over the exterior surface of the other flap and projects into the slot provided on the other flap. At this time the manual folding force imposed on the flaps is released, and the natural memory of the flaps, namely their tendency to return to their original flat blank condition, causes the flaps to swing outwardly and effectively engage the tab within the slot and effectively lock the upper and lower flaps together. In this locked position, the upper and lower flaps are still angled inwardly into the interior of the box and maintain a positive closure at the end of the box without significantly interfering with proper utilization of the interior storage compartment.

With the improved box of this invention, as aforesaid, an operator can readily assemble the box into an elongate tubular closed configuration in surrounding relationship to a sandwich, and then can simultaneously effect closure of opposite ends of the box since the folding of the flaps into the interior of the box and the locking or snap securement thereof in the locked position can be easily performed simultaneously at opposite ends of the box since the folding and locking of the flaps at one end can easily be accomplished through the manipulation of one hand of the operator.

Other objects and purposes of the present invention will be apparent to persons familiar with structures of this general type upon reading the following specification and inspecting the accompanying drawings.

Figure 1:
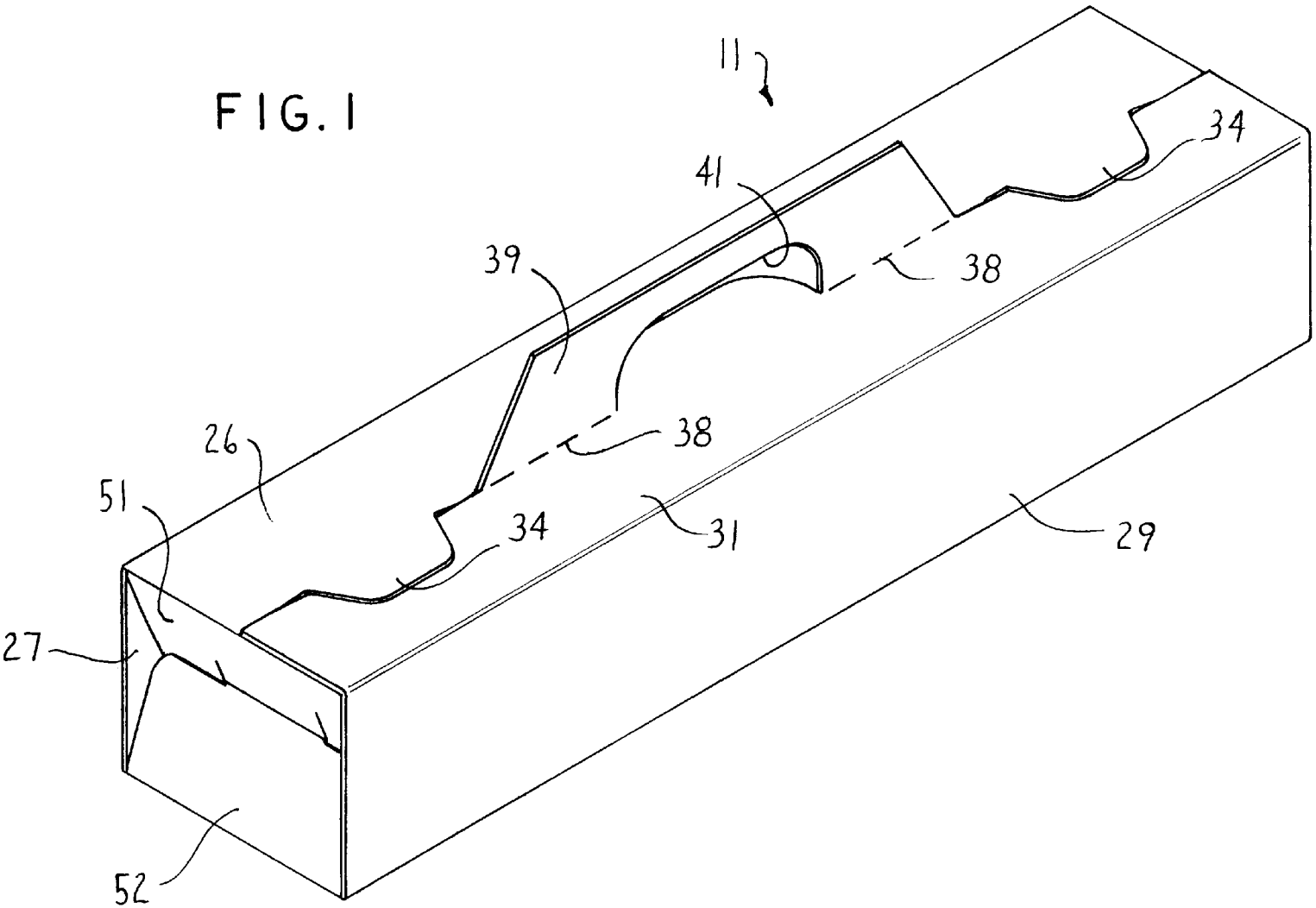
FIG. 1 is a perspective view of a wrapper-type box according to the present invention, the box being illustrated in its closed assembled condition wherein it is usable for storing and transporting a food product such as a sandwich.
Figure 3:
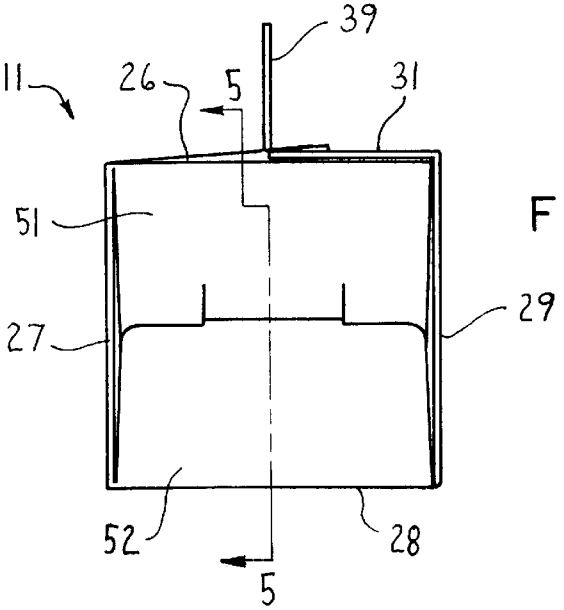
FIG. 3 is an end view of the assembled box of FIG. 1.
Figure 2:
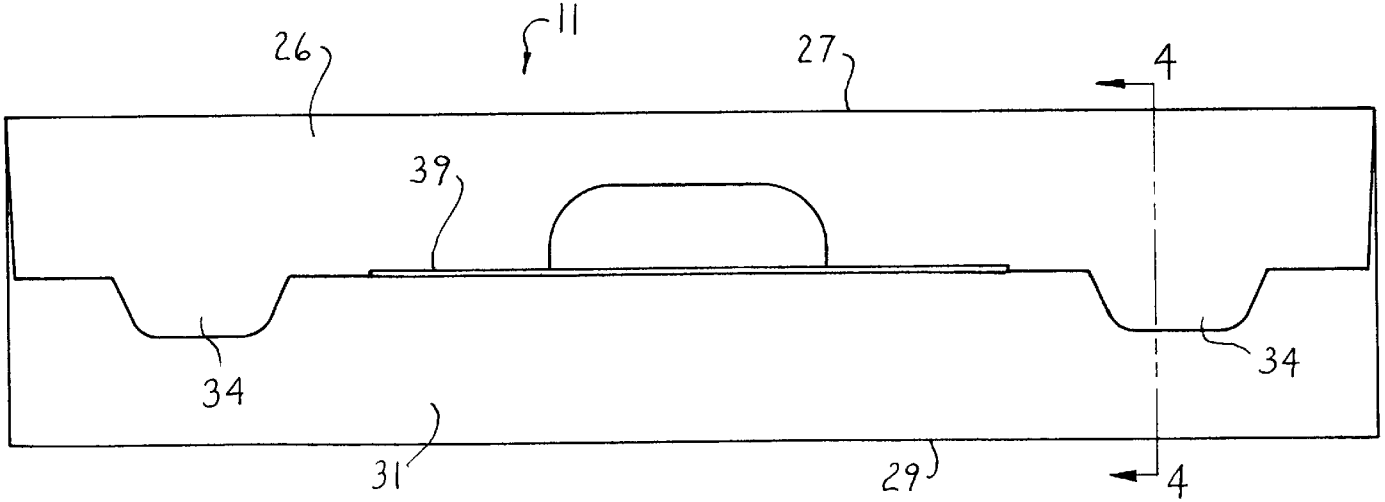
FIG. 2 is a top view of the assembled box of FIG. 1.
Figure 4:
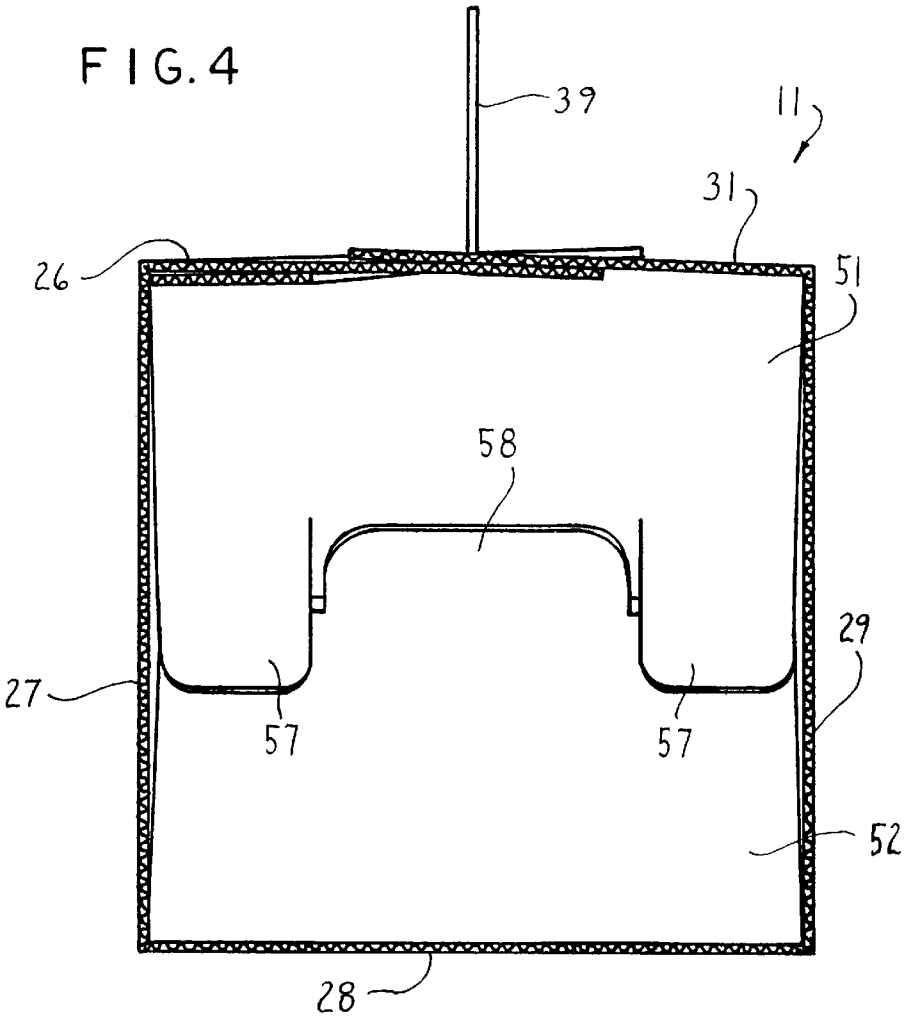
FIG. 4 is an enlarged cross sectional view taken generally along line 4—4 in FIG. 20.

Certain terminology will be used in the following description for convenience in reference only, and will not be limiting. For example, the words "upwardly" "downwardly", "rightwardly" and "leftwardly" will refer to directions in the drawings to which reference is made. Said terms will also refer to the conventional orientation of the box during handling and use thereof. The words "inwardly" and "outwardly" will refer to directions toward and away from, respectively, the geometric center of the box and designated parts thereof. Said terminology will include the words specifically mentioned, derivatives thereof, and words of similar import.

DETAILED DESCRIPTION

Referring to the drawings, FIG. 1 illustrates therein a wrapper-type box 11 according to the present invention, the box being illustrated in its assembled condition. The box 11 when assembled defines therein an interior storage compartment or chamber 12 (FIG. 5) which, in the preferred embodiment, is horizontally elongated and is particularly configured so as to be suitable for containment therein of an object such as an elongate sandwich.

The wrapper-type box 11 is, in its entirety, formed from a one-piece monolithic flat blank 13 (FIG. 6) which is cut from a thin sheet of rather stiff board material, which material preferably comprises a double faced corrugated cardboard.

The blank 13 is defined primarily by a main body part 14 which, when the blank is in the flat and nonfolded condition, is substantially rectangular. This main body part 14 is defined between generally parallel end edges 18 and 19 which are substantially perpendicularly joined between substantially parallel and longitudinally extending side edges 16 and 17.

The main body part 14 of the blank 13 also has a plurality of generally parallel fold lines 21–24 formed therein, which fold lines at opposite ends are disposed in substantially perpendicular and intersecting relation with respect to the parallel end edges 16–17. The fold lines 21-24 divide the main body part 14 into a plurality of adjacent and adjoining elongate rectangular panels 26–29, which define the top, bottom and side walls of the box 11 when the latter is in the assembled condition shown in FIG. 1.

More specifically, the main body part 14 includes the first panel 26 which defines the top wall of the box and which extends between the longitudinal edge 18 and the fold line 210. This panel 26 is joined through the fold line 21 to the adjacent panel 27, the latter defining one of the side walls of the box. The panel 27 in turn joins through the next fold line 22 to the panel 28 which defines the bottom wall of the box. The panel 28 in turn joins through the fold line 23 to a further panel 29 which defines the other side wall of the box. This panel 29 in turn joins through the fold line 24 to an edge flap 31, the latter extending between the fold line 24 and the other longitudinal edge 19. The edge flap 31, in the illustrated embodiment, is of smaller transverse dimension than are the panels 26–29. The edge flap 31 creates a locking engagement with the top panel 26 when the box is in the assembled condition of FIG. 1, as explained hereinafter.

Figure 6:
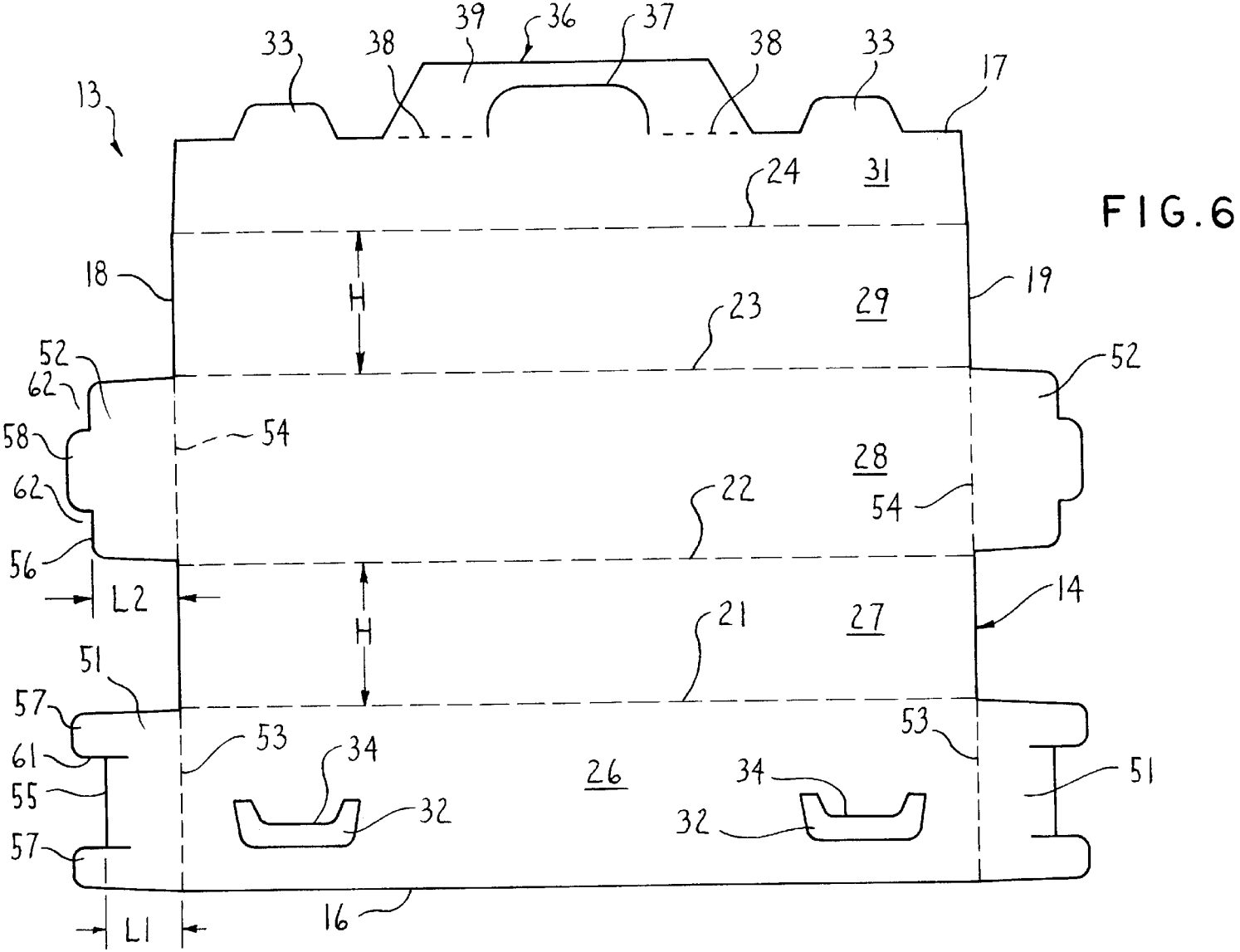
FIG. 6 illustrates the box in its opened condition, namely its formation as a one-piece flat blank, prior to its assembly into the closed condition illustrated in FIG. 1.

The generally rectangular configuration of the main body part 14, and the provision of the generally parallel and longitudinally extending fold lines, permits the main body part 14 to be folded from the flat open position of FIG. 6 into the closed position of FIG. 1 so that the main body part thus assumes a generally elongate hollow tubular configuration of generally rectangular cross section. In this closed position, the side walls 27 and 29 are disposed in generally parallel relationship and extending generally perpendicularly between the top and bottom walls 26 and 28, respectively. The top wall 26 in turn creates a locking or latching engagement with the edge flap 31 so as to maintain the main body part in the closed tubular condition.

To effect latching between the top wall 26 and edge flap 31, the top wall 26 has a pair of slits or slots 32 formed transversely therethrough. These slots 32 are spaced inwardly from the free edge 16 so as to be disposed transversely within the width of the top wall, with the pair of slots 32 being spaced longitudinally so as to be disposed more closely adjacent the longitudinal ends of the top wall. The slots 32 in the illustrated and preferred embodiment have a generally U-shaped configuration, whereby each slot effectively defines therein a cantilevered latching tab 34 which projects toward the adjacent free edge 16.

The edge flap 31 in turn mounts thereon a pair of latching tabs 33, which tabs are spaced longitudinally along the longitudinal edge 17 and are cantilevered outwardly therefrom. The tabs 33 are sized and positioned so as to permit them to be readily inserted through a respective one of the slots 32. This latter function is accomplished by folding the main body part 14 into a generally tubular configuration so that the edge flap 31 generally overlies the top panel 26, with the edge flap 31 projecting sidewardly toward the longitudinal edge 16 of the top panel. The edge flap 31 is moved sidewardly over the top panel 26 from the direction of the longitudinal edge 16, and during this sideward overlapping relative movement the tabs 33 can be slidably inserted into the slots 32 so as to effect a latching of the edge panel 31 to the top panel 26. The slidable insertion of the flaps 33 through the slots 32 causes the flaps 33 to effect a frictional engagement with the undersurface of the top panel 26 in the vicinity of the slots 32 to thus effectively hold the main body part in the assembled tubular condition. This also causes the tabs 34 to overlie the upper surface of the edge flap 31.

The edge flap 31 also has an enlarged handle-defining tab 36 formed thereon, which handle-defining tab 36 is located between the locking tabs 33 and is disposed substantially midway along the longitudinal edge 17. This handle-defining tab 36 is also cantilevered outwardly in generally coplanar relation with the edge panel 31 and, interiorly thereof, has a generally U or approximately half circular cut line 37 formed therethrough. This cut line 37 is spaced inwardly from the free edge of the tab 36, and the ends or legs of the cut line 37 terminate generally at a line which constitutes an extension of the longitudinal edge 17. The ends of the cut line 37 in turn join to a pair of score or fold lines 38, the latter projecting outwardly in opposite directions from the cut line generally along the longitudinal edge 17 so as to terminate at the side edges of the handle-defining tab 36. The cut line 37 and fold lines 38 cooperate with the outer edge of the handle-defining tab 36 to define a generally U-shaped handle 39, the latter being structurally joined to the edge panel 31 solely by the fold lines 38. These latter fold lines 38, in conjunction with the cut line 37, enable the U-shaped handle 39 to be folded upwardly about the score lines 38 so as to assume a position wherein it projects upwardly in generally perpendicular relation to the edge panel 31 and top panel 26, and hence the handle projects upwardly from the assembled box. When the handle 39 is in this upwardly projecting orientation, the handle defines thereunder an opening 41 which is defined between the cut line and the top of the box, which opening permits the fingers of a hand to be inserted therethrough so as to permit manual grasping of the handle when carrying of the box is desired.

To close off the ends of the hollow tubular construction defined by the panels 26–29 when the main body part 14 is folded into the closed condition, the one-piece flat blank 13 is also provided with a pair of end flanges 51 and 52 associated with each of the end edges 16 and 17. The end flange 51 is cantilevered longitudinally outwardly in coplanar relation with the top panel 26 and is joined thereto through a transverse fold line 53, the latter extending generally along the respective end edge 18 or 19. In similar fashion the other cooperating edge flange 52 is cantilevered outwardly in generally coplanar relation with the bottom panel 28, with the edge flange 52 and bottom panel 28 being joined by a transverse fold line 54 which also extends along the respective end edge 18 or 19 of the main body part 14. These cantilevered end flanges 51 and 52 have a transverse width which substantially corresponds to the transverse width of the top and bottom panels, although it will be appreciated that the transverse widths of the end flanges 51 and 52 may be slightly less than the width of the top and bottom panels since the end flanges must fit between the side panels 27 and 29 when the box is in the assembled position.

The end flap 52 as cantilevered outwardly from the fold line 54 terminates at a free edge 56. This end flap 52 also has a latching tab 58 which is cantilevered outwardly a limited extent beyond the free edge 56. This latching tab 58 is, in the illustrated embodiment, positioned inwardly from opposite side edges of the end flap 52 and is positioned substantially centrally along the free edge 56. This end flap 52 has a length L2 as measured perpendicularly between the fold line 54 and free edge 56 which is less than the height H of the side walls 27 and 29, with this length L2 preferably being slightly greater than one-half the height H.

As to the end flap 51, it projects outwardly from the fold line 53 through a perpendicular distance L2 so as to terminate in a free edge 55. This distance L1 is also significantly less than the height H, and is also preferably somewhat greater than one-half the height H. In the preferred embodiment the lengths L1 and L2 are of similar magnitude, and in fact may be equal, and more importantly the sum of the lengths L1+L2 is significantly greater than the height H.

The end flap 51 also has at least one, and in the illustrated embodiment two, tabs 57 which are coplanar with the end flap and project outwardly beyond the free edge 55. These tabs 57 are, in the illustrated embodiment, disposed adjacent opposite sides of the end flap 51 and accordingly define therebetween a slot-like open region 61 which is centrally positioned sidewardly of the flap and has a sideward dimension which is at least equal to or slightly greater than the sideward width of the tab 58 on the end flap 52 so that the tab 58 can freely pass into and through the slotlike region 61. Similarly, the tabs 57 on end flap 51 are positioned and sized so as to pass through the open corner regions 62 which are disposed adjacent the free edge of the end flap 52 on opposite sides of the tab 58.

Figure 5:
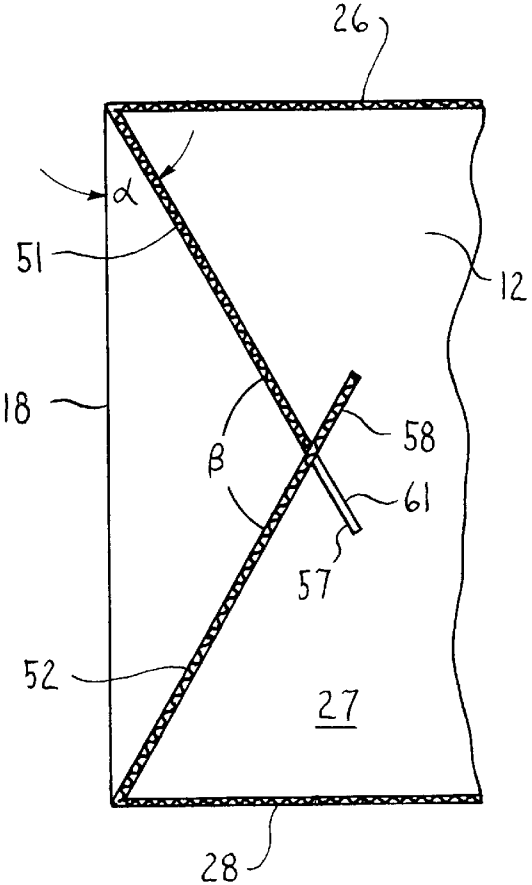
FIG. 5 is an enlarged, fragmentary cross sectional view taken generally along line 5—5 in FIG. 3.

During assembly of the blank 13 into the closed condition illustrated by FIGS. 1–4, the end flaps 51 and 52 at each end of the blank are folded inwardly initially through an angle of substantially 90° so that the end flaps 51 and 52 project generally toward the opposed respective top or bottom wall, with the flaps 51 and 52 being folded inwardly past 90° so that the flaps both angle inwardly into the interior of the box, causing the flaps to effectively engage one another substantially as illustrated in FIG. 5 so that the tab 58 projects through the slotlike region 61, and similarly the tabs 57 project through the corner recesses 62. Thus, the end flaps 51 and 52 in the vicinity of the respective free edges thereof substantially abut one another and effectively lock the flaps 51 and 52 in a closed position wherein they extend across the open end of the box, but are effectively angled inwardly substantially as illustrated by FIG. 5.

When in the latched position illustrated by FIG. 5, the flaps 51 and 52 are each inclined inwardly from an end edge, such as the end edge 18 in FIG. 5, by an angle α typically in the range of from at least 30° to about 45°. This ensures that the end flaps 51 and 52, where they abuttingly contact one another, intersect one another at a significant angle β so that the memory associated with each of the flaps, namely the tendency for each flap 51 and 52 to fold outwardly back towards its original position, causes the flap 51 to abuttingly engage the flap 52, and the flap 52 in turn to abuttingly engage the flap 51, thereby retaining the two flaps in the closed angled position shown by FIG. 5. The angle β will typically be in the range of from about 90° to about 120°.

The assembly of the box 11 from the flat blank condition of FIG. 6 into the assembled box configuration of FIG. 1 will now be briefly described to ensure a complete understanding thereof.

When the blank 13 is to be assembled into the box 11, the blank is positioned on a working surface and an object such as a submarine sandwich is positioned over the bottom wall panel 28 of the blank. The worker then grasps the longitudinal edges of the main body part of the blank and folds the blank upwardly into a tubular configuration in surrounding relationship to the sandwich. The worker will presumably substantially simultaneously fold both side walls 27 and 29 upwardly relative to the bottom wall so as to partially enclose the sandwich, and will then substantially simultaneously fold the top wall 26 and edge flap 31 inwardly toward one another. In this latter condition, the side walls will be flared outwardly with respect to one another so that the top wall 26 and edge flap 31 are sidewardly spaced. The worker then applies sufficient pressure to the top wall 26 and edge panel 31 so as to cause these panels to be slightly angled downwardly as they project inwardly, and by then relatively moving the top wall 26 and edge panel 31 inwardly toward one another, the edge panel 31 is slidably moved over the upper surface of the top wall 26. Due to the fact that these panels 26 and 31 are inclined slightly with respect to one another, the relative sliding of the edge panel 31 over the top wall 26 causes the cantilevered tabs 33 to be inserted through the slots 32, and this latter insertion results in the tabs 34 on the top wall panel 26 moving over the upper surface of the edge panel 31. After the top wall 26 and edge panel 31 are relatively slidably moved toward one another such that the tabs 33 are fully inserted through the slots 32, the manual pressure is relieved from the top and side walls, and thus the natural memory of the folded box (i.e. the tendency of the flaps and panels of the box to return toward their original unfolded condition) causes the top wall 26 and edge panel 31 to tend to straighten out, that is swing upwardly about their fold lines, whereby the top wall 26 and edge panel 31 assume a more flat or planar relationship, except that they are disposed in at least partial overlapping relationship to one another. During this return movement caused by the memory of the blank, the top wall and edge panel may undergo some limited transverse distortion in the regions where the flaps 33 abut the underside of the top wall 26, and in the regions where the flaps 34 abut the top wall of the edge flap 31. Significant frictional engagement occurs at these regions, and this is sufficient to securely hold the top wall 26 and edge flap 31 in engagement with one another, and thereby maintain the tubular side wall construction of the box in a generally closed hollow tubular condition.

With the box in the partially formed condition described above, and containing an object such as a submarine sandwich therein, the ends of the box are still open. The worker then engages the end flaps 51–52 provided at each end of the box and initiates a folding operation. The operator will typically be able to simultaneously manipulate the flaps 51 and 52 at the leftward end of the box with his left hand, and substantially simultaneously manipulate the flaps 51–52 at the rightward end of the box with his right hand.

As to this manipulation, both flaps 51 and 52 at one end of the box are folded about their fold lines so that the flaps extend generally transversely across the open end of the box, with the flaps being in a partial overlapping relationship One of the flaps, for example the top flap 51, is initially folded through a further extent so as to angle inwardly into the interior of the tubular construction, and thereafter the other flap 52 is similarly folded inwardly so as to also be angled inwardly into the interior. During the inward folding of the second flap 52, the tab 58 thereon engages the exterior or outer surface of the end flap 51 and slides along this surface, causing a corresponding greater inward folding of the end flap 510. This continues until the tab 58 aligns with the open region 61, at which time the natural resiliency or memory of the end flap 51 causes it to pivot outwardly about its fold line, thereby causing the tabs 58 to pass through the open region 610. The outward pivoting of the flap 51 due to the memory of the blank continues until the end flap 51, in the region of the free edge thereof, abuts the flap 52 in the region of its free end. At this time the tab 58 projects through the open region 61, and similarly the tabs 57 project through the open regions 62. The end flaps 51 and 52 are effectively locked together in that they can no longer pivot outwardly toward the open end of the box, and hence the end of the box is effectively closed by the interengaged flaps 51 and 52. The flaps thus remain engaged in a position wherein they each angle inwardly and are locked together, substantially as illustrated by FIG. 5.

While the flaps are described above as being engaged by first folding flap 51 inwardly and thereafter folding the flap 52 inwardly, it will be appreciated that this sequence can be reversed so that the lower flap 52 is first folded inwardly, and the upper flap 51 thereafter folded inwardly so as to cause interengagement between the flaps in the same manner as described above and as illustrated in FIG. 5.

When it is desired to open the box, the end flaps 51 and 52 can be manually disengaged, if desired, by pressing one of the flaps inwardly a sufficient extent to permit disengagement between the tabs 57, 58 and the corresponding slots or open regions 61, 62, following which the flaps can be manually folded outwardly away from the end of the box if desired.

Once the box has been fully assembled, the worker can then lift the handle and fold it upwardly about the score lines 38, thereby permitting the box to be readily gripped and transported. The box thus provides a secure containment of a sandwich, is capable of maintaining the sandwich in a clean and sanitary condition while minimizing the likelihood that moisture or other liquids will leak through the box, and the box is more effective in maintaining the sandwich either hot or cold.

When removal of the sandwich from the box is desired, the customer will normally merely grasp the top wall 26 and edge flange 31 and effects separation thereof, thereby resulting in opening of the box and permitting access to the sandwich.

It will be appreciated that numerous others shapes and positions of the flaps and of the tabs and open regions can be provided on the cooperating end flaps 51 and 52 while still functioning in the desirable manner of this invention. The illustrated arrangement, however, is desirable since the provision of the tab 58 and its projection through the slot 61 defined between the tabs 57 thus provides sideward restraint of the tab 58 in both sideward directions due to the confinement between the tabs 57. This thus provides increased sideward strength or rigidity to the assembled box and hence minimizes the tendency of the top wall of the box to move laterally relative to the bottom wall.

Although a particular preferred embodiment of the invention has been disclosed in detail for illustrative purposes it will be recognized that variations or modifications of the disclosed apparatus, including the rearrangement of parts, lie within the scope of the present invention.

The embodiments of the invention in which an exclusive property or privilege is claimed are defined as follows:

1. A horizontally-elongated wrapper-type box for enclosing and transporting a food item, comprising:

a pair of substantially parallel and horizontally elongated upright side walls hingedly joined at lower longitudinally extending edges thereof by a pair of generally parallel fold lines to a generally horizontally elongated and substantially horizontally extending bottom wall, and a generally horizontally elongated/and horizontally positioned top wall disposed in upwardly spaced relation from said bottom wall and being substantially parallel thereto when the box is in a closed configuration, said top wall along one longitudinally extending edge thereof being joined to an upper edge of one said side wall by a further fold line which extends parallel to said pair of fold lines, said top wall having a free edge defining the other longitudinally extending edge thereof;

a latch structure connected between said other side wall and said top wall for stationarily connecting said other side wall to said top wall in generally perpendicular relation to one another so that the top, bottom and side walls maintain a generally hollow tubular wall structure which is generally rectangular in cross section and is horizontally elongated, said tubular wall structure having a first pair of substantially parallel first and second walls respectively defined by said side walls and a second pair of substantially parallel first and second walls respectively defined by said top and bottom walls;

a handle fixed to said tubular wall structure and projecting upwardly from said top wall;

an end wall structure associated with each end of said tubular wall structure for closing off open ends thereof, the end wall structure associated with each end of said tubular wall structure including first and second end flaps which are respectively joined to and fold-inwardly from said firsts and second,walls of one of said first pair of walls and said second pair of walls of said tubular wall structure, said first and second end flaps being respectively joined to said first and second walls by respective first and second fold lines which extend perpendicular to said longitudinal direction and which respectively define an end edge of the respective said first and second wall, said first and second end flaps being cantilevered from the respective said first and second walls and terminating in free edges, so as to be foldable inwardly toward one another for closing the open end of the tubular wall structure;

said first and second end flaps respectively including, closely adjacent the free edges thereof, a latching tab and a latching slot, and the combined cantilevered length of said first and second end flaps being greater than the perpendicular spacing between said first and second walls, said first and second end flaps being folded about the respective said first and second fold lines so that said first and second end flaps both angle inwardly into an interior of the hollow tubular wall structure until the latch tab passes through the latch slot, whereupon release of the end flaps enables them to swing outwardly a limited extent until the end flaps engage one another and maintain an engaged position therebetween, wherein both of said end flaps remain in a position wherein they are angled with respect to one another and angle inwardly into the interior of the hollow tubular wall structure to close the respective open end thereof.

2. A wrapper-type box according to claim 1, wherein said first and second walls are said top and bottom walls, respectively.

3. A wrapper-type box according to claim 1, wherein each of said first and second end flaps is cantilevered through a predetermined length so as to terminate at the respective free edge thereof, said latching tab of said first end flap is cantilevered outwardly from said free edge thereof, and a slot is defined adjacent said free edge of said first end flap sidewardly adjacent said latching tab;

said second end flap having a length which projects from said second fold line and terminates at said free edge thereof, said second end flap having a latching tab which is cantilevered outwardly from said free edge of said second end flap, and said slot of said second end flap is defined adjacent said free edge thereof sidewardly adjacent said latching tab of said second end flap;

the length of said first end flap as measured perpendicularly between said first fold line and the respective free edge, when combined with the length of the second end flap as measured perpendicularly between said second fold line and the respective free edge, being greater than the perpendicular distance between the first and second walls to which the end flaps are joined;

said latching tab of said first end flap being generally aligned with and passing through said slot of said second end flap and said latching tab of said second end flap being generally aligned with and passing through said slot of said first end flap when said first and second end flaps are folded inwardly into a latching position, whereby said first and second end flaps directly abut one another substantially at the free edges thereof so as to maintain the first and second end flaps in an engaged position wherein they close the open end of the tubular wall structure and angle inwardly from the open end with the first and second end flaps when in said latching position extending relative to one another at an included angle therebetween of between about 90° to about 120°.

4. A wrapper-type box according to claim 3, wherein said first and second walls are said top and bottom walls, respectively.

5. A wrapper-type box according to claim 3, wherein said latch structure includes a latching flap having one longitudinally extending edge joined to an upper edge of said other side wall by a longitudinally extending fold line and said latching flap having a free edge defining the other longitudinally extending edge thereof, said latching flap further including a pair of latching tabs which are spaced longitudinally from one another and are cantilevered sidewardly from said free edge of said latching flap so as to project toward said top wall, said latching structure also including latch-receiving slots and latching tabs associated with said top wall for engagement with the latching tabs on said latching flap, said latching tabs of said top wall being cantilevered sidewardly from said free edge thereof, whereby said latching flap and said top wall are superimposed one above the other to permit engagement between the latching tabs and latching slots.

6. A wrapper-type box according to claim 5, wherein said box is formed in its entirety from a one-piece monolithic flat sheetlike blank of stiff cardboard.

7. A wrapper-type box according to claim 1, wherein said box is formed in its entirety from a one-piece monolithic flat sheetlike blank of stiff cardboard.

8. A wrapper-type box according to claim 1, wherein the entire said first end flap lies within and defines a single plane and the entire said second end flap lies within and defines a single plane.

9. A wrapper-type box formed in its entirety from a one-piece monolithic flat blank formed from a sheet of stiff a cardboard, said blank comprising a plurality of substantially planar side walls which are horizontally elongated and of the same longitudinal length, a first said side wall terminating in a first longitudinally extending free edge and at its other longitudinally extending edge being joined by a first fold line to an adjacent longitudinally extending edge of a second said side wall, said second side wall at its other longitudinally extending edge being joined by a second fold line to an adjacent longitudinally extending edge of a third said side wall, said third side wall at its other longitudinally extending edge being joined by a third fold line to an adjacent longitudinally extending edge of a fourth said side wall, whereby said first through fourth side walls can be folded into a hollow tubular wall structure of generally rectangular cross section;

an edge flap joined to the other longitudinally extending edge of said fourth side wall by a fourth fold line, said edge flap and said first side wall being disposed in generally overlapping and superimposed relationship to one another when said blank is folded into said tubular wall construction, said first side wall and said edge flap having cooperating latching tabs and slots which engage transversely relative to the longitudinal direction for securing said edge flap and said first side wall together to maintain said tubular wall structure in an assembled condition;

a handle flap joined to one of said first side wall and said edge flap and being folded upwardly so as to define an upwardly projecting handle which can be manually grasped;

a first end flap cantilevered outwardly from each end of said first side wall, said first end flap being joined to said first side wall by a first folding line which extends transverse to the longitudinal direction and which is generally aligned with free end edges of said second and fourth side walls extending transverse to the longitudinal direction, and a second end flap cantilevered outwardly from each end of said third side wall and being joined thereto by a second folding line which extends transversely to the longitudinal direction and is generally aligned with the free end edges of said second and fourth side walls, one of said first and second end flaps, closely adjacent a free end thereof having an outwardly projecting latching tab, the other of said first and second end flaps adjacent a free end thereof having a tab-receiving slot, said first and second end flaps being foldable transversely to the respective first and third side walls and extending at an angle inwardly into a respective open end of the tubular wall structure so that the latching tab and latching slot on said first and second end flaps engage and hold the first and second end flaps in inwardly angled relationship relative to one another in a latched position for closing off the respective open end of the tubular wall structure.

10. A wrapper-type box according to claim 9, wherein the entire said first end flap lies within and defines a single plane and the entire said second end flap lies within and defines a single plane.

11. A wrapper-type box according to claim 9, wherein said first and second end flaps in said latched position extend relative to one another at an included angle therebetween of between about 90° to about 120°.

* * * * *

UNITED STATES PATENT AND TRADEMARK OFFICE

CERTIFICATE OF CORRECTION

PATENT NO. : 5 899 377

DATED : May 4, 1999

INVENTOR(S) : Scott Speese et al

It is certified that error appears in the above-identified patent and that said Letters Patent is hereby corrected as shown below:

Column 9, line 22; delete "/".
line 52; delete ",".
line 61; delete ",".
Column 11; line 20; delete "a" (first occurence).

Signed and Sealed this

Thirtieth Day of May, 2000

*Attest:*

Q. TODD DICKINSON

*Attesting Officer*

*Director of Patents and Trademarks*